United States Patent [19]

Büll

[11] Patent Number: 4,474,510

[45] Date of Patent: Oct. 2, 1984

[54] HYDRAULIC MINE-ROOF SUPPORT

[75] Inventor: Hans Büll, Wuppertal, Fed. Rep. of Germany

[73] Assignee: Hermann Hemscheidt Maschinenfabrik GmbH & Co., Wuppertal, Fed. Rep. of Germany

[21] Appl. No.: 434,476

[22] Filed: Oct. 15, 1982

[30] Foreign Application Priority Data

Oct. 15, 1981 [DE] Fed. Rep. of Germany ..... 3141040

[51] Int. Cl.[3] ..... E21D 15/44

[52] U.S. Cl. ..... 405/296; 405/292; 405/302

[58] Field of Search ..... 405/291, 292, 295, 296, 405/299, 300, 301, 302; 299/33

[56] References Cited

U.S. PATENT DOCUMENTS

| | | | |
|---|---|---|---|
| 3,436,922 | 4/1969 | Irresberger et al. | 405/292 |
| 3,478,522 | 11/1969 | Rieschel | 405/292 |
| 3,800,545 | 4/1974 | Groetschel | 405/292 |
| 4,155,675 | 5/1979 | Friedrichs | 405/291 |
| 4,222,686 | 9/1980 | Bell et al. | 405/295 |

*Primary Examiner*—David H. Corbin

*Attorney, Agent, or Firm*—Berman, Aisenberg & Platt

[57] ABSTRACT

The support assembly is made up of a floor-standing runner member 1, a hydraulically vertically-adjustable prop 2 mounted on the same, a roof canopy 3 supported by the same and a rockfall shield 4 hinged to the same on the backfill side which is guided to be pivotable in a vertical plane by two direction-control members 5 and 6 articulated to the runner member so as to be spaced apart one behind the other. The front direction-control member 6 is constructed as a hydraulic thrust piston mechanism. Via a control circuit 8 the hydraulic control valve 7 of the direction-control member 6 is connected to measuring devices 9 usable to measure the position of at least two mutually variably spaced apart support assembly reference points. If the reference points deviate from the preset normal position of the support assembly, pressure fluid acts on the front direction-control member 6 via the control circuit 8 until the normal position has been regained.

2 Claims, 1 Drawing Figure

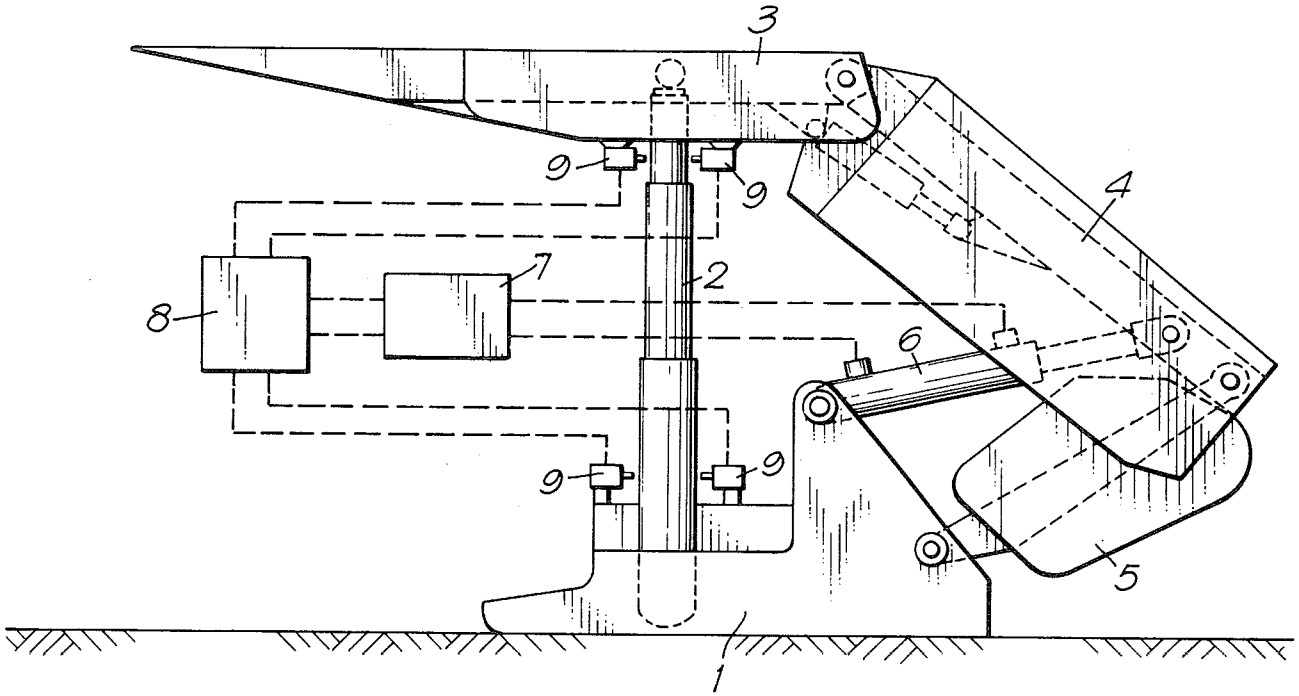
1
2
3
4
5
6
7
8
9
9
9
9

HYDRAULIC MINE-ROOF SUPPORT

This invention relates to a hydraulic support assembly in accordance with the definitive part of the main claim.

In a hydraulic support assembly whose rockfall shield hinged to the roof canopy or a corresponding rocker arm is guided by direction-control elements articulated to the floor-standing runner member, the length of the direction-control elements is determined substantially by the extended elevation of the support assembly, i.e. by the preset adjustment range of the props. The mutual angular position of the direction-control members is the result of the position given to the so-called pole, which lies in the extension of the direction-control member axes outside the support assembly at the point of intesection of the lines of force. The tensile or compressive forces acting on the direction-control members are of varying size and depend on the respective angular position of the prop relative to the runner member or the canopy and—depending on the particular roof canopy and floor construction—on the relative position of the roof canopy and the runner member. In addition, forces arising in the longitudinal direction of the canopy, which come into being as forces of reaction during the setting operation or due to convergence, act on the direction-control members. As a consequence, it is necessary to construct rigid direction-control members in such a way that they can also absorb the forces which arise in the most unfavourable stressing cases.

In order to keep the stressing on the direction-control member joint axes within defined limits, it has been proposed in accordance with German Patent Specification No. 27 29 564 to construct the direction-control member on the working face side as a cylinder piston unit. This unit has two displacement stroke compartments separated from each other by a partition in which a respective piston is arranged. When the props are set in position one piston is acted on over its ring area and the other over its full piston area. The double-piston cylinder is then located in a middle position in which one piston can be displaced outwards by one-half the total stroke, while the other cylinder can be retracted by the same amount. The cylinder compartments are sealed by pressure limiting valves, so that the joint axes of the direction-control members are always only stressed by a defined force.

The present invention aims to substantially relieve the components of the support assembly from additional forces that can act on the shield support assembly due to the construction of the seam in the varying elevated positions of the props.

This aim is achieved by the means stated in the characterising part of the main claim. The advantageous construction of the invention is the subject matter of the subordinate claim.

The invention starts from that position of the support assembly in which the components are subject to the minimum stress. This position is defined by the position of at least two selected points of reference on the support assembly. The distance and/or the angular position of the points of reference to one another is measured. Serving as the output valve, the result is fed via a control circuit to a control valve which allows the front direction-control member of the lemniscate guide mechanism to be acted on hydraulically in one or the other direction. If the mutual position of the reference points alters because of the construction of the seam, i.e. as a consequence of a varying elevation of the prop or through relative displacements of the roof canopy and the runner member, then the control circuit is actuated and the control valve correspondingly passes pressure fluid to the front direction-control member. This same has its piston area or the ring area acted on in accordance with the measured deviation. As a consequence, the extension of the direction-control member is increased or reduced until the points of reference have returned to their original position. In this way the tensile force in the direction-control member are made to remain substantially constant over the entire displacement range of the prop.

The support assembly according to the invention will now be described by way of an example of an embodiment shown in the accompanying drawing.

The illustrated hydraulic support assembly has as its principal components the floor-standing runner member 1, the hydraulically vertically-adjustable prop or props 2 articulated to the same, the roof canopy 3 supported by the same and a rockfall shield 4 hinged to the same on the backfill side and guided on the floor side to be pivotable in a vertical plane by a lemniscate guide mechanism. The assembly moving device which also belongs to the support assembly is not shown in the drawing.

The lemniscate guide is formed by a rigid direction-control member 5 arranged on the backfill side and a further hydraulically longitudinally-adjustable direction control element 6 arranged on the working-face side. Both direction control elements, 5 and 6, which in general are constructed as pairs of direction control members, are articulated to the runner member 1 and in the same way are hinged to the rockfall shield 4 with joint axes. The front direction control member 6 may be constructed as a thrust piston mechanism actuable on both sides. The supply of pressure to the two piston sides of the direction control member 6 ensues through a hydraulic control valve 7 which, in its turn, is switched by a hydraulic, electrohydraulic or electronic control circuit. This control circuit is only symbolically illustrated in the drawing and provided with the reference numeral 8. It receives signals from one or a plurality of measuring devices 9 fitted to such locations of the support assembly which—in dependence on the kinematics of the support assembly—can alter their mutual position as a consequence of the construction of the seam by way of varying elevations. The measuring devices 9 measure the mutual position of at least two reference points, such reference points being definable, for example, by the position of the prop relative to the runner member and/or the roof canopy. It is possible, however, to include also other suitable reference points on the support assembly in the control circuit with a mutual position that is altered by the kinematics of the suppot assembly. In the "normal position" of the support assembly that, for example, is defined by a preset position of the prop, the front direction-control member 6 occupies a fixed mean extended position. If now the mutual position of the set reference poinrs alters during the advancing and resetting operation, then the measuring devices 9 feed corresponding signals into the control circuit 8 for conversion into control signals which are passed to the control valve 7. This conversion process proceeds in the manner that the front direction-control member 6 is acted on by pressure fluid on one or the other of its piston sides until the support assembly has been returned into the preset position. The direction-control member 6 is switched without pressure as soon as a preset internal pressure has been reached.

I claim:

1. An hydraulic mine-roof support assembly comprising a base member adapted to run over the floor of a mine, at least one vertically-extensible hydraulic prop tiltably supported at a lower portion thereof on said base member and extending upwards therefrom, a roof support member tiltably carried by said hydraulic prop at an upper portion thereof whereby extension and retraction of said prop causes said roof support member to rise and fall with respect to said base member, an inclined rock-fall shield hingedly connected at an upper end thereof to said roof support member, a first direction-control member pivotally connected at one end portion thereof to said base member and pivotally connected at an opposite end portion thereof to a lower portion of said rock-fall sheild, a second direction-control member, located above said first direction-control member, pivotally connected at one end portion thereof to said base member and pivotally connected at an opposite end portion thereof to said rock-fall shield, said second direction-control member being in the form of an hydraulic ram comprising a single piston movable in a cylinder, inlets in the cylinder of said ram, one inlet on each side of said piston, separate conduits connected to said inlets for the supply and exhaust of hydraulic fluid to and from the cylinder of said ram, hydraulic control valve means located in said conduits to control the flow of hydraulic fluid therethrough, control means operatively connected to said hydraulic control valve means to effect operation of said valve means, and measuring means arranged on the mine-roof support assembly in the region of said base member and said roof support member to detect and measure relative tilting movement between said hydraulic prop and said base member and roof support member respectively, said measuring means being connected to said control means by signal transmission lines whereby detection of such relative tilting movement by said measuring means causes a signal to be passed from said measuring means to said control means with the result that the control means operate said hydraulic control valve means to cause hydraulic fluid to flow along said conduits whereby the load on said ram longitudinally thereof remains substantially constant notwithstanding such relative tilting movement.

2. An hydraulic mine-roof support assembly according to claim 1, wherein said measuring means comprise two measuring devices mounted on said base member adjacent the lower end portion of said hydraulic prop and two further measuring devices mounted on the underside of said roof support member adjacent the upper end portion of said hydraulic prop, said first two measuring devices being arranged to detect and measure relative tilting movement between said prop lower end portion and said base member, and said further two measuring devices being arranged to detect and measure relative tilting movement between said prop upper end portion and said roof support member.

* * * * *